US010202886B1

(12) United States Patent
Teslovich

(10) Patent No.: US 10,202,886 B1
(45) Date of Patent: Feb. 12, 2019

(54) ENGINE TEMPERATURE CONTROL SYSTEM

(71) Applicant: Darius Teslovich, Franklin, PA (US)

(72) Inventor: Darius Teslovich, Franklin, PA (US)

( * ) Notice: Subject to any disclaimer, the term of this patent is extended or adjusted under 35 U.S.C. 154(b) by 79 days.

(21) Appl. No.: 15/144,692

(22) Filed: May 2, 2016

Related U.S. Application Data

(60) Provisional application No. 62/156,208, filed on May 2, 2015.

(51) Int. Cl.

| | |
|---|---|
| ***F02B 29/04*** | (2006.01) |
| ***F01P 7/14*** | (2006.01) |
| ***F01P 1/06*** | (2006.01) |
| ***F01P 3/00*** | (2006.01) |
| ***F02B 33/00*** | (2006.01) |
| ***F01P 5/12*** | (2006.01) |
| ***F01P 11/16*** | (2006.01) |
| ***F01P 7/16*** | (2006.01) |
| ***F01P 11/08*** | (2006.01) |
| ***F01M 5/00*** | (2006.01) |
| ***F01N 3/20*** | (2006.01) |
| ***F01P 3/02*** | (2006.01) |
| ***F01P 3/12*** | (2006.01) |

(52) U.S. Cl.
CPC ..... *F01P 5/12* (2013.01); *F01M 5/007* (2013.01); *F01N 3/2066* (2013.01); *F01P 3/02* (2013.01); *F01P 3/12* (2013.01); *F01P 7/165* (2013.01); *F01P 11/08* (2013.01); *F01P 11/16* (2013.01); *F01N 2610/105* (2013.01); *F01P 2003/021* (2013.01)

(58) Field of Classification Search
CPC ..... F01P 5/12; F01P 3/02; F01P 3/12; F01P 7/165; F01P 11/08; F01P 2003/021; F01P 11/16; F01M 5/007; F01N 3/2066; F01N 2610/105
USPC ..... 60/599; 123/41.02, 41.08, 41.1, 41.14, 123/41.15, 41.21, 41.29, 41.31, 41.49, 123/563
See application file for complete search history.

(56) References Cited

U.S. PATENT DOCUMENTS

| | | | | | |
|---|---|---|---|---|---|
| 3,134,371 | A * | 5/1964 | Crooks | F01P 3/20 | 123/41.31 |
| 4,348,991 | A * | 9/1982 | Stang | F01P 7/14 | 123/41.29 |
| 4,362,131 | A * | 12/1982 | Mason | F01P 3/20 | 123/41.1 |
| 4,918,923 | A * | 4/1990 | Woollenweber | F01N 13/082 | 123/41.49 |
| 6,244,232 | B1 * | 6/2001 | Ban | B60H 1/038 | 123/41.29 |

(Continued)

*Primary Examiner* — Thai Ba Trieu
(74) *Attorney, Agent, or Firm* — William F. Lang, IV; Lang Patent Law LLC

(57) ABSTRACT

An engine temperature control system is provided for heating and/or cooling engine fluids to resist deviation of the temperature of these fluids from a temperature range wherein optimal fluid performance is achieved. Some examples of the temperature control system provide for preheating fluids such as coolant, lubricant, or diesel exhaust fluid prior to starting the engine. Other examples of the temperature control system provide for improved cooling of lubricants utilized for high heat generating components such as turbochargers, continuing cooling of these fluids after the engine is stopped.

8 Claims, 3 Drawing Sheets

(56) References Cited

U.S. PATENT DOCUMENTS 6,464,027 B1 * 10/2002 Dage ..... F01P 11/20 123/41.14
6,691,925 B2 * 2/2004 Roberts ..... B60H 1/14 122/26
6,729,133 B1 * 5/2004 Sorter ..... F01P 7/165 123/41.29
7,040,303 B2 * 5/2006 Uzkan ..... F01P 7/165 123/563
7,650,753 B2 * 1/2010 Muller ..... F01P 7/165 123/41.31
7,912,599 B2 * 3/2011 Eiraku ..... F01P 5/04 123/41.02
7,921,829 B2 * 4/2011 Hayashi ..... F01P 7/165 123/41.31
8,061,309 B2 * 11/2011 Lenz ..... F01P 7/165 123/41.08
8,272,432 B2 * 9/2012 Major ..... B60H 1/00492 237/12.3 B
8,601,986 B2 * 12/2013 Faulkner ..... F01P 7/165 123/41.29
8,869,757 B2 * 10/2014 Kim ..... F01P 7/165 123/41.12
2009/0283604 A1 * 11/2009 Martinchick ..... B60H 1/034 237/12.3 B
2011/0067422 A1 * 3/2011 Ichishi ..... B60H 3/0085 62/176.1
2011/0111920 A1 * 5/2011 Gooden ..... F01M 5/005 477/98
2011/0132291 A1 * 6/2011 Ulrey ..... F01P 7/167 123/41.1
2012/0103283 A1 * 5/2012 Mehring ..... F01P 3/02 123/41.02
2012/0118248 A1 * 5/2012 Mehring ..... F01P 3/02 123/41.08
2013/0186351 A1 * 7/2013 Quix ..... F01P 7/165 123/41.02
2013/0255604 A1 * 10/2013 Rollinger ..... F01P 7/165 123/41.15
2013/0298851 A1 * 11/2013 Nishikawa ..... F01P 7/165 123/41.21
2014/0129063 A1 * 5/2014 Clark ..... H01M 10/625 701/22
2014/0245975 A1 * 9/2014 Quix ..... F01P 5/10 123/41.08
2014/0326198 A1 * 11/2014 Kaneda ..... F01P 3/12 123/41.08
2014/0374058 A1 * 12/2014 Greiner ..... F28D 20/02 165/52
2017/0159516 A1 * 6/2017 Roth ..... F01M 5/007

* cited by examiner

ENGINE TEMPERATURE CONTROL SYSTEM

CROSS REFERENCE TO RELATED APPLICATION

This application claims the benefit of U.S. provisional patent application Ser. No. 62/156,208, filed May 2, 2015, and entitled "Engine Temperature Control System."

TECHNICAL FIELD

The present invention relates to engine temperature control systems and methods. More specifically, systems and methods of optimizing the temperature of various fluids within an internal combustion engine are provided.

BACKGROUND INFORMATION

Internal combustion engines rely on fluids for multiple functions within the engine, including combustion, cooling, lubrication, and emissions control. These fluids perform best within a certain temperature range, and temperatures above or below that range can lead to increased emissions, increased fuel consumption, degradation of the fluids, and decreased engine life. Diesel exhaust fluid performs best above 78° F., and oil performs best above 180° F. Oil will also degrade when it becomes too hot, as can occur when oil is used to cool a turbocharger. Thus, heating and cooling of these fluids before, during, and after operation of the engine can be advantageous for achieving the most efficient and effective use of the engine.

SUMMARY

The above needs are met by a temperature control system for an engine. The temperature control system has a coolant storage vessel, with a heater in thermal communication with the coolant storage vessel. The temperature control system further includes a control system that is structured to activate the heater when the coolant has a temperature below a predetermined temperature threshold, and to deactivate the heater once the coolant has a temperature of at least a predetermined threshold.

The above needs are further met by another example of a temperature control system for an engine, having a lubricant cooling reservoir in thermal communication with the engine coolant. A pump is structured to direct engine coolant to the cooling reservoir. A control system is structured to receive information about the temperature of the lubricant, and to increase or decrease power supplied to the pump based on deviation of the temperature of the lubricant from a predetermined temperature.

Additionally, the above needs are met by a method of controlling temperature of engine fluids utilized with an engine. The method includes heating an engine fluid, monitoring a temperature of the engine fluid, and discontinuing heating the engine fluid upon the engine fluid reaching a predetermined temperature threshold.

Furthermore, the above needs are met by another method of controlling temperature of engine fluids utilized within an engine. The method includes monitoring a temperature of the engine fluid, and supplying engine coolant to a position within thermal communication of the engine fluid in a quantity that is proportional to deviation of the temperature of the engine fluid from a predetermined threshold.

These and other aspects of the invention will become more apparent through the following description and drawings.

BRIEF DESCRIPTION OF THE DRAWINGS

Like reference characters denote like elements throughout the drawings.

DETAILED DESCRIPTION

Figure 1:
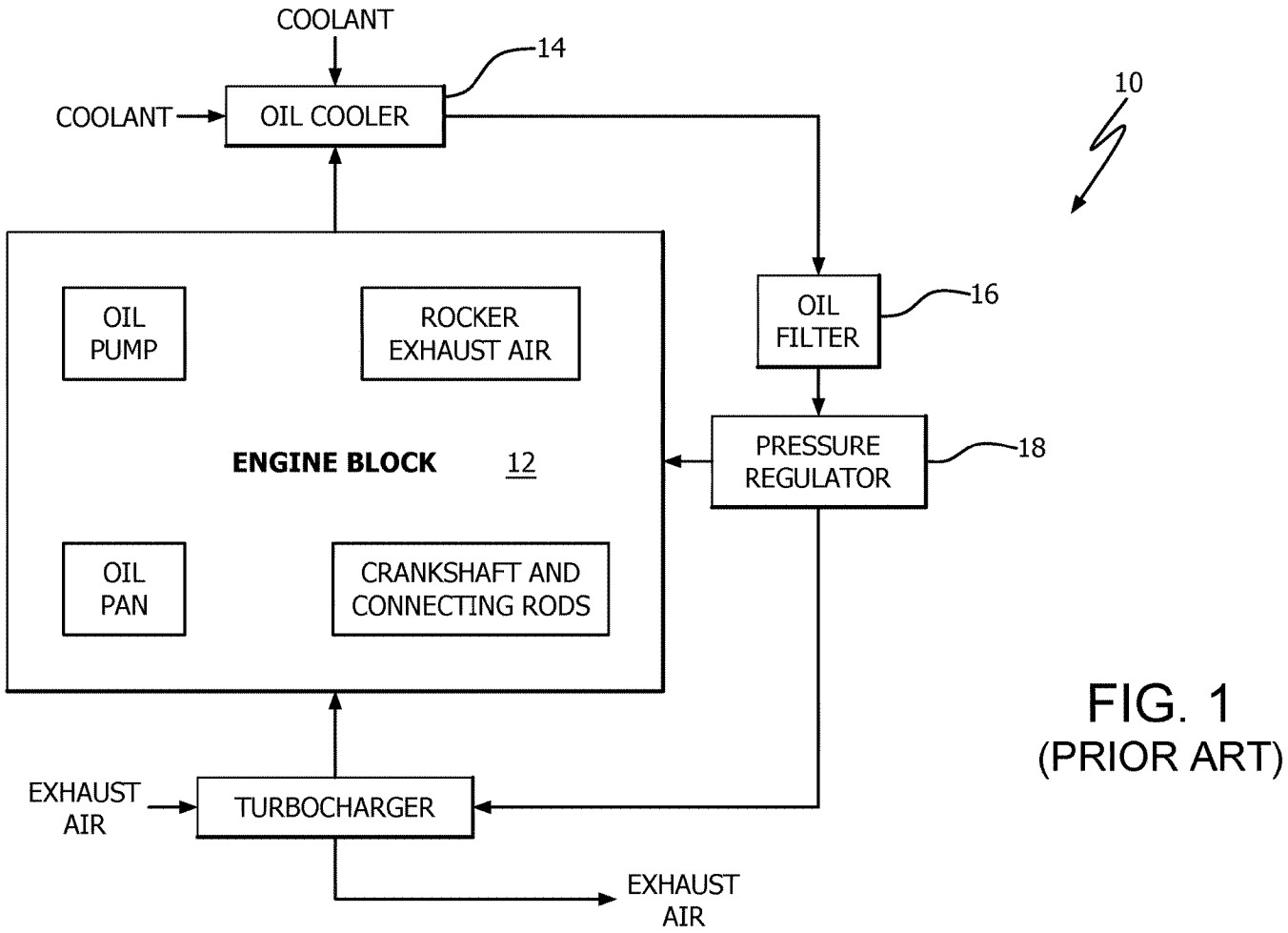
FIG. 1 (PRIOR ART)
FIG. 1 is a schematic diagram of various components of a standard engine.

Referring to the drawings, a temperature control system is illustrated. Some examples of the temperature control system serve not only as cooling systems but also as heating systems. Engine oil operates most efficiently and effectively at a temperature range of 180° F. to 185° F. Additionally, maintaining motor oil within this temperature range will resist oxidation and nitration. For diesel engines, diesel exhaust fluid freezes at 12° F., making the fluid useless until it becomes warm enough to melt. Thus, a temperature control system that reduces the time required to reach this temperature range, and then maintains this temperature range, is advantageous for an internal combustion engine. Cold engines provide poor air emissions. Excessive heat within the exhaust also increases emission pollution as well as contributing to premature exhaust component failures.

FIG. 1 illustrates the standard manner in which a turbocharger is cooled. Oil from the engine block 12 is taken to an oil cooler 14, where coolant from the vehicles cooling system removes heat from the oil. The oil then proceeds through an oil filter 16 and pressure regulator 18. From the pressure regulator 18, oil proceeds back to the engine block for lubricating the engine, as well as to the turbocharger 20 for lubricating and cooling the turbocharger 20. The turbocharger 20 operates at temperatures well in excess of the preferred operating temperature for the oil, causing rapid degradation of the oil. Additionally, the turbocharger 20 may continue to operate for a period of time after the engine is shut down, and therefore continues to require cooling and lubrication. One of the goals of some examples of the temperature control system described herein is to provide a better means of cooling the turbocharger.

Figure 2:
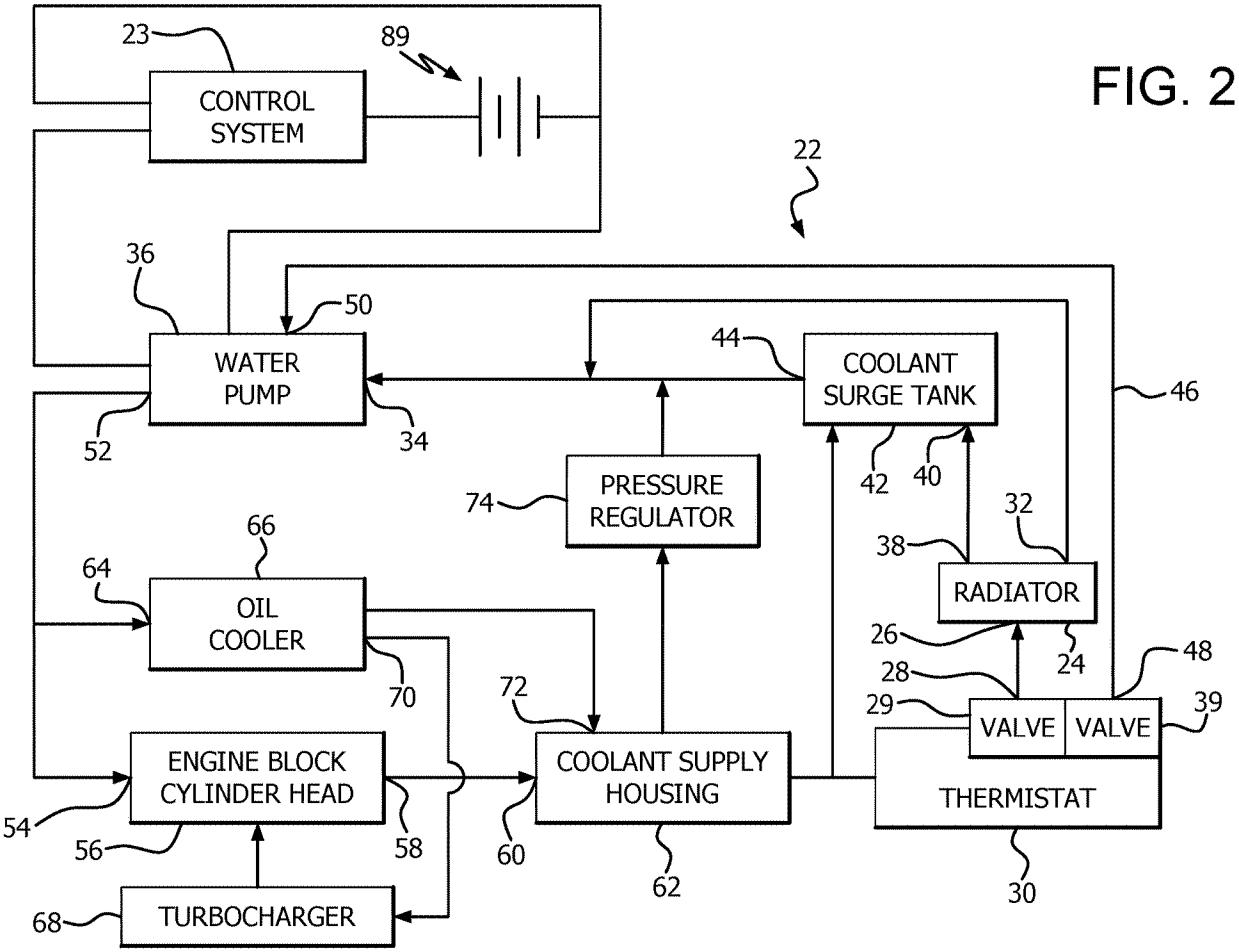
FIG. 2 is a schematic diagram of an engine temperature control system.

FIG. 2 illustrates one example of a temperature control system 22. The temperature control system 22 is added to the existing vehicle cooling system, with some components of that system being replaced. In addition to the main radiator, a second radiator 24 is provided. The second radiator 24 is connected in series with the vehicle's standard radiator, and is typically located in front of the vehicle's standard radiator within the vehicle, although it may be located in other locations depending on available space. The second radiator 24 provides an additional means of cooling the coolant when engine cooling is desired. The second radiator 24 has an inlet 26 that is connected to the outlet 28 of the thermostat 30 (described in greater detail below). Outlet 32 of the radiator 24 is connected to the inlet 34 of the water pump 36. The radiator outlet 38 is connected to the inlet 40 of the coolant surge tank 42. The outlet 44 of the surge tank 42 is connected to the inlet 34 of the water pump 36.

If engine conditions are such that passing coolant through the radiator 24 is unnecessary or undesirable (for example, if warming rather than cooling is desired), then the radiator 24 may be bypassed. A bypass 46 is connected between the outlet 48 of the thermostat 30 and the inlet 50 of the water pump 36. The outlets 28, 48 of the thermostat include electrically operated valves 29,39 that may be opened or closed to direct coolant along the desired path.

The water pump 36 is a variable speed pump. In the illustrated example, the water pump 36 is an electrically powered pump, so that varying the speed of the water pump 36 may be controlled by varying the voltage and/or current supplied to the water pump 36. Additionally, power may be supplied to the water pump 36 before starting the engine and/or after shutting down the engine as described in greater detail below.

The outlet 52 of the water pump 36 is connected to the inlet 54 of the engine block 56, providing cooling for the engine in a manner well known to those skilled in the art. In order to more effectively maintain desired engine temperatures, the temperature sensors within the engine block 56 may be replaced with thermistors, which provide a more rapid response to temperature changes. These thermistors are connected to a control system which may be the vehicle's standard computer (reprogrammed to accommodate the temperature control system 22) and/or another microcontroller that supplements or replaces the standard vehicles computer. This control system is structured to receive information about the temperature of the lubricant from the thermistors, as well as to monitor engine operation and to include a timer. The control system is further structured to open and close valves for bypasses, increase or decrease water pump speed, and/or activate heating elements for the reservoir 24, based on deviation of the temperature of the lubricant from a predetermined temperature or in response to other conditions. The outlet 58 of the engine block 56 is connected to the inlet 60 of a coolant supply housing 62 which will be described in greater detail below.

The outlet 52 of the water pump 36 is also connected to the inlet 64 of the oil cooler 66 in order to direct engine coolant to the cooling reservoir and to place the lubricant cooling reservoir in thermal communication with the engine coolant, so that oil from the engine block 56 may be cooled before being used to cool the turbocharger 68. The outlet 70 of the oil cooler 66 is connected to the inlet 72 of the coolant supply housing 62. The coolant supply housing 62 supplies coolant to a pressure regulator 74 (in the case of a compressed natural gas engine) as well as to the inlet 34 of the water pump 36, and to the thermostat 30.

The temperature control system 22 is structured so that it may be powered by the electrical system of the vehicle, a separate electrical power supply that may take the form of an onboard power generator within the vehicle, or a connection to a plug for a standard electrical wall outlet. The illustrated example includes the power supply 89. Regardless of which of the above examples of a control system is utilized, the controller 23 of the control system can be selected from a variety of microcontrollers, including general-purpose programmable microcontrollers, programmable logic devices such as field programmable gate arrays, application specific integrated circuits, and custom integrated circuits. In some examples of the temperature control system 22, the ability to power the system before starting the engine, and/or after the engine is shut off, is desirable as explained in greater detail below.

Figure 3:
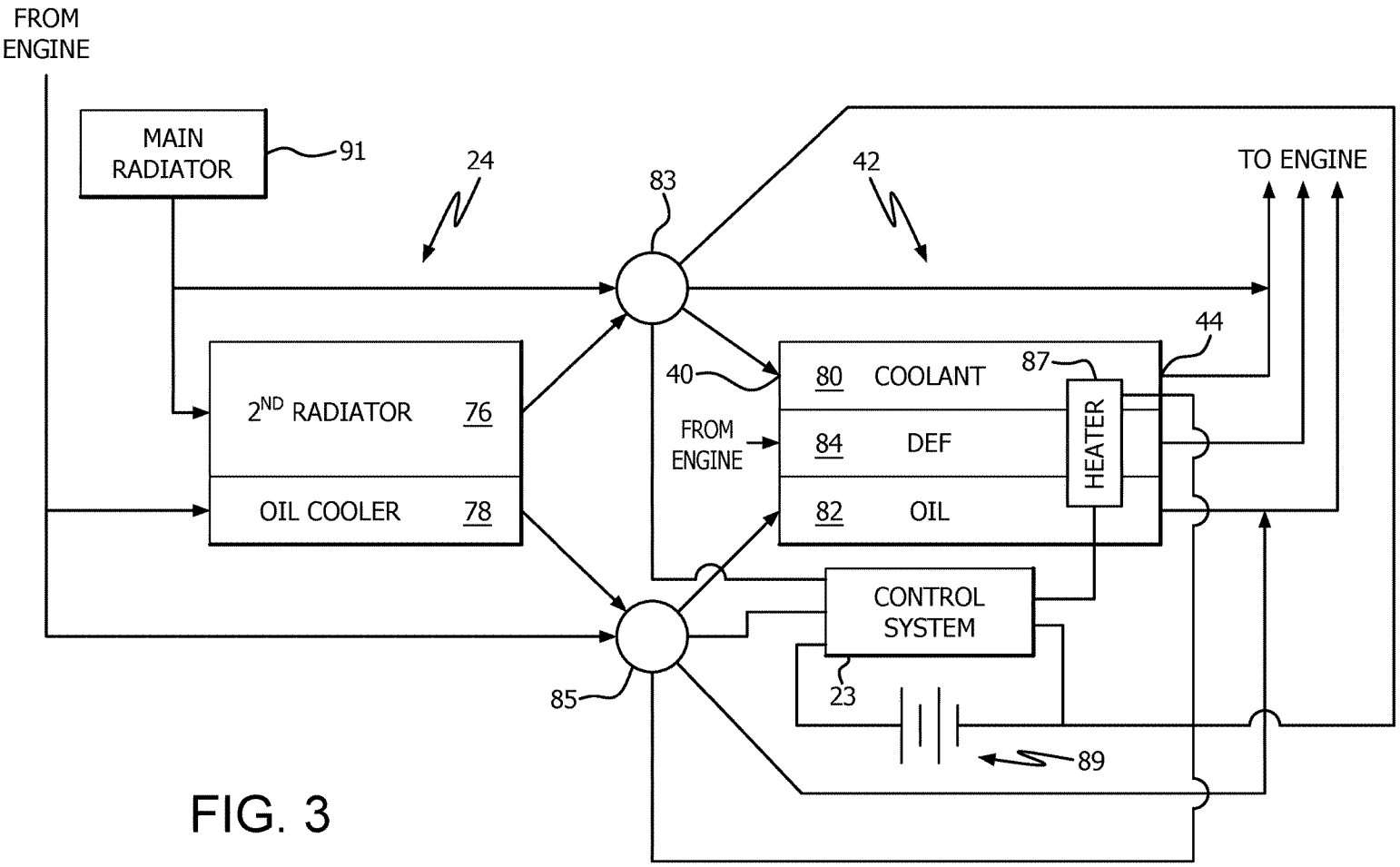
FIG. 3 is a schematic diagram of a secondary radiator and fluid reservoir for the engine temperature control system of FIG. 2.

Referring to FIG. 3, the second radiator 24, as well as the coolant surge tank 42, are illustrated in greater detail. The radiator 24 is in series with the main radiator 91. The radiator 24 includes a coolant portion 76, which in the illustrated example is an upper portion of the radiator 24, and an oil cooling portion 78, which in the illustrated example is a lower portion of the radiator 24. Some examples of the radiator 24 include coolant portions 76 occupying about two thirds of the radiator 24, and oil cooling portions 78 occupying about one third of the radiator 24. Thus, the radiator 24 provides a means of cooling oil in addition to the oil cooler 66, providing more effective cooling of the oil, better preserving the oil, and providing better cooling for the turbocharger 68. Just as coolant may bypass the radiator 24 when cooling is not desired, oil may also bypass the radiator 24 when cooling of the oil is not desired.

The coolant reservoir 42 includes not only a coolant portion 80, but also an oil portion 82 and a diesel exhaust fluid portion 84. The coolant reservoir 42 includes one or more heating elements/heaters 87 in thermal communication with the coolant reservoir 42 that can be utilized to warm the coolant portion 80, oil portion 82, and/or the diesel exhaust fluid portion 84. The heating elements are operatively connected to the control system, so that the control system can activate or deactivate the heating elements. Some examples may heat all three fluids simultaneously, while other systems may include separate, independently controlled heating elements in thermal communication with the reservoir portion for each fluid. As another alternative, bypasses 83, 85 utilizing electrically controlled valves operatively connected to the control system may be provided so that individual fluids for which warming is not desired to not enter the reservoir during heating of other fluids.

In use, the temperature control system 22 may optionally be activated prior to starting the engine of the vehicle, which is particularly advantageous in cold climates. By warming the coolant, the oil, and/or the diesel exhaust fluid prior to starting the engine, and circulating these fluids as described above and as otherwise known by those skilled in the art of engines, the disadvantages of a cold start are avoided. Prior to starting the engine, the heating elements within the reservoir 42 are activated, the water pump 36 is activated, and coolant is directed through the bypass 46 because the additional cooling provided by the radiator 24 is unnecessary at this point in time. Oil is also directed through a bypass that avoids passage through the radiator 24, since the goal of this point in time is warming rather than cooling the oil. The current and/or voltage supplied to the heating element can be varied by the control system as needed to achieve and maintain a desired temperature.

Once the engine has been sufficiently warmed, which can be determined either by the passage of a predetermined time interval and/or by monitoring the engine temperature, the engine can be started. Either after starting the engine, or after the engine has reached a desired temperature after starting, the temperature control system 22 is switched to its cooling function. The heating elements within the reservoir 42 are deactivated, and both coolant and oil are passed through the radiator 24 in order to cool them. The temperature within the engine 56 and/or turbocharger 68 are monitored, and the speed of the water pump 36 adjusted accordingly to provide appropriate cooling.

When the engine is shut down, power continues to be supplied to the water pump 36, and coolant and oil continue to circulate through the system to maintain their cooling and lubricating effects. If a turbocharger 68 is present, the turbocharger will likely continue to run for a short period of time after the engine has been shut down, and will thus require continued cooling and lubrication. Once a predetermined temperature has been reached, and/or when a predetermined time interval has passed, the temperature control system 22 can be shut down.

Other examples of the engine control system 22 may include additional features. Such additional features may include instruments disposed on the vehicle's dashboard that are supplied with information from the control system about the status of the engine and operation of the temperature control system 22. As another example, coolant as well as cooling oil may be supplied to the turbocharger for cooling the turbocharger.

The present invention therefore provides a means of more precisely controlling the temperature of various engine components and fluids. Examples of the invention may warm preselected fluids prior to starting the engine, and/or continue to cool preselected engine components after the engine has been deactivated. As a result of better temperature control, efficiency is increased, emissions are improved, and the life span of fluids is improved.

A variety of modifications to the above-described embodiments will be apparent to those skilled in the art from this disclosure. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. A temperature control system for an engine, comprising:

a cooling system having an engine coolant;

an engine lubricant system;

a coolant reservoir including a coolant portion, a lubricant portion, and a diesel exhaust fluid portion;

a temperature sensor disposed within the engine for measuring a coolant temperature;

a heater in thermal communication with the coolant portion and with the diesel exhaust fluid portion of the reservoir;

a control system including executable instructions stored in non-transitory memory to:

receive the coolant temperature from the temperature sensor;

determine whether the coolant temperature is above or below a predetermined threshold based on the coolant temperature;

activate the heater when the coolant temperature is below the predetermined temperature threshold; and deactivate the heater once the coolant temperature is equal to the predetermined temperature threshold.

2. A temperature control system for an engine, comprising:

a cooling system having an engine coolant;

an engine lubricant system;

a coolant reservoir including a coolant portion, a lubricant portion, and a diesel exhaust fluid portion;

a temperature sensor disposed within the engine for measuring a coolant temperature;

a heater in thermal communication with the coolant portion of the coolant reservoir;

a second radiator connected in series to a main radiator;

at least one bypass valve including a first bypass valve connected to a bypass line bypassing the second radiator and a second bypass valve connected to the second radiator;

a control system including executable instructions stored in a non-transitory memory to:

receive the coolant temperature from the temperature sensor;

determine whether the coolant temperature is above or below a predetermined first temperature threshold based on the coolant temperature received from the temperature sensor;

activate the heater when the coolant temperature is below the predetermined first temperature threshold; and deactivate the heater once the coolant has a temperature of at least the predetermined first temperature threshold;

control the first bypass valve connected to the second radiator to an open position to direct coolant away from the second radiator when the coolant temperature is below a second predetermined temperature threshold; and control the second bypass valve connected to the second radiator to an open position to direct coolant to the second radiator when the coolant temperature is above a predetermined temperature threshold.

3. The temperature control system according to claim 2, further comprising an electrical power supply for a pump forming a part of the cooling system and for the control system, the power supply being operable when the engine has not been activated, wherein the control system further includes executable instructions to deactivate the power supply subsequent to deactivation of the engine.

4. The temperature control system according to claim 2, wherein the second radiator further comprises:

a coolant portion in serial communication with the main radiator; and a lubricant portion in communication with the engine lubrication system.

5. The temperature control system according to claim 2, further comprising:

the diesel exhaust fluid portion of the reservoir in thermal communication with the heater;

an electrical power supply powering the heater;

wherein the electrical power supply supplies power to the heater when the engine is deactivated;

wherein the electrical power supply further supplies power to the control system to activate the heater prior to activation of the engine.

6. The temperature control system according to claim 2:

wherein the lubricant portion of the coolant reservoir is in thermal communication with the engine coolant;

further comprising:

a pump for pumping the engine coolant to the lubricant portion of the coolant reservoir; and the control system including executable instructions stored in non-transitory memory to:

receive the coolant temperature from the temperature sensor;

determine whether the coolant temperature is above or below a predetermined temperature threshold;

increase a speed at which the pump operates if the coolant temperature increases above the predetermined threshold; and decrease the speed at which the pump operates if the coolant temperature falls below the predetermined threshold.

7. A temperature control system for an engine, the engine having an engine block and a turbocharger, the temperature control system comprising:

a cooling system having an engine coolant;

an engine lubricant system;

a coolant reservoir including a coolant portion, a lubricant portion, and a diesel exhaust fluid portion, wherein the lubricant portion of the coolant reservoir is in thermal communication with the engine coolant, and wherein the lubricant portion of the coolant reservoir includes an entrance to receive the engine coolant from at least one of the engine block and the turbocharger, and an exit to return the engine coolant back to the at least one of the engine block and the turbocharger;

a pump for pumping the engine coolant to the coolant portion of the coolant reservoir;

a heater in thermal communication with the coolant reservoir;

a temperature sensor disposed within the engine for measuring a coolant temperature;

a control system having executable instructions stored within a non-transitory memory to:

receive the coolant temperature from the temperature sensor;

determine whether a coolant temperature is above or below a predetermined first temperature threshold based on the coolant temperature received from the temperature sensor;

activate the heater when the coolant temperature is below the predetermined first temperature threshold;

deactivate the heater when the coolant temperature equal to or exceeding the predetermined first temperature threshold;

determine whether the coolant temperature threshold is above or below a second predetermined temperature threshold based on the coolant temperature received from the temperature sensor;

increase power supplied to the pump when the temperature rises above the second predetermined threshold; and decrease power supplied to the pump when the temperature falls below the second predetermined threshold.

8. The temperature control system according to claim 7, further comprising a power supply for the pump, wherein the power supply is operatively connected to the control system to supply power to the pump after the engine has been deactivated.

* * * * *